US007889602B2

(12) United States Patent
Behling et al.

(10) Patent No.: US 7,889,602 B2
(45) Date of Patent: Feb. 15, 2011

(54) WATCH WITH A MULTIFUNCTIONAL DISPLAY

(75) Inventors: Christoph Behling, London (GB); Gregoire Renoux, Neuchatel (CH); Thomas Houlon, Boudry (CH)

(73) Assignee: LVMH Swiss Manufactures SA, La Chaux-de Fonds (CH)

( * ) Notice: Subject to any disclaimer, the term of this patent is extended or adjusted under 35 U.S.C. 154(b) by 92 days.

(21) Appl. No.: 12/063,629

(22) PCT Filed: Sep. 11, 2006

(86) PCT No.: PCT/EP2006/066209

§ 371 (c)(1),
(2), (4) Date: Feb. 12, 2008

(87) PCT Pub. No.: WO2007/031477

PCT Pub. Date: Mar. 22, 2007

(65) Prior Publication Data

US 2009/0154296 A1 Jun. 18, 2009

(30) Foreign Application Priority Data

Sep. 13, 2005 (CH) ..... 4185/05

(51) Int. Cl.
*G04B 19/20* (2006.01)
*G04B 47/00* (2006.01)

(52) U.S. Cl. ..... 368/10; 368/37; 368/77; 368/233; 116/298

(58) Field of Classification Search ..... 368/233, 368/35–38, 231; 116/298
See application file for complete search history.

(56) References Cited

U.S. PATENT DOCUMENTS

| | | | | |
|---|---|---|---|---|
| 1,501,398 | A * | 7/1924 | Eacrett | 235/113 |
| 5,446,702 | A * | 8/1995 | Mossuz et al. | 368/37 |
| 5,475,653 | A | 12/1995 | Yamada et al. | |
| 5,500,835 | A * | 3/1996 | Born | 368/11 |
| 5,668,781 | A * | 9/1997 | Jeannet et al. | 368/28 |
| 5,710,545 | A * | 1/1998 | Dunn | 340/825.36 |
| 5,790,478 | A * | 8/1998 | Besson | 368/66 |
| 5,917,778 | A * | 6/1999 | James et al. | 368/17 |
| 6,456,568 | B1 * | 9/2002 | Geiger | 368/10 |
| 6,543,681 | B1 * | 4/2003 | Wiederrecht et al. | 235/60 C |
| 6,646,958 | B1 * | 11/2003 | Geiger | 368/10 |

(Continued)

FOREIGN PATENT DOCUMENTS

CH 190208 A 4/1937

(Continued)

OTHER PUBLICATIONS

International Search Report for Application PCT/EP2006/066209 dated Jan. 29, 2007.

(Continued)

*Primary Examiner*—Sean Kayes
(74) *Attorney, Agent, or Firm*—Pearne & Gordon LLP

(57) ABSTRACT

Watch provided with a multifunctional aperture display capable of displaying symbols corresponding to one or several special functions and to the date. The movement of the display discs is ensure by bidirectional motors and the display discs or mobiles have several series of digits of different colour for differentiating the display of the different functions.

16 Claims, 4 Drawing Sheets

U.S. PATENT DOCUMENTS

| | | | | |
|---|---|---|---|---|
| 6,842,404 | B2 * | 1/2005 | Haselberger | 368/223 |
| 7,027,360 | B2 * | 4/2006 | Kitahara et al. | 368/28 |
| 7,057,976 | B2 * | 6/2006 | Berseth et al. | 368/10 |
| 7,539,084 | B2 * | 5/2009 | Berseth | 368/10 |

FOREIGN PATENT DOCUMENTS

| | | | |
|---|---|---|---|
| CN | 1490685 | A | 4/2004 |
| EP | 0415734 | A2 | 3/1991 |
| EP | 0621519 | A2 | 10/1994 |
| EP | 0735442 | A1 | 10/1996 |
| EP | 0744675 | A1 | 11/1996 |
| GB | 2017356 | A | 10/1979 |
| WO | 2005-006087 | A1 | 11/2002 |
| WO | 2002-093273 | A1 | 1/2005 |
| WO | 2006-001857 | A | 2/2006 |

OTHER PUBLICATIONS

China Office action for Chinese application No. 2006800335460 dated Apr. 21, 2010.

* cited by examiner

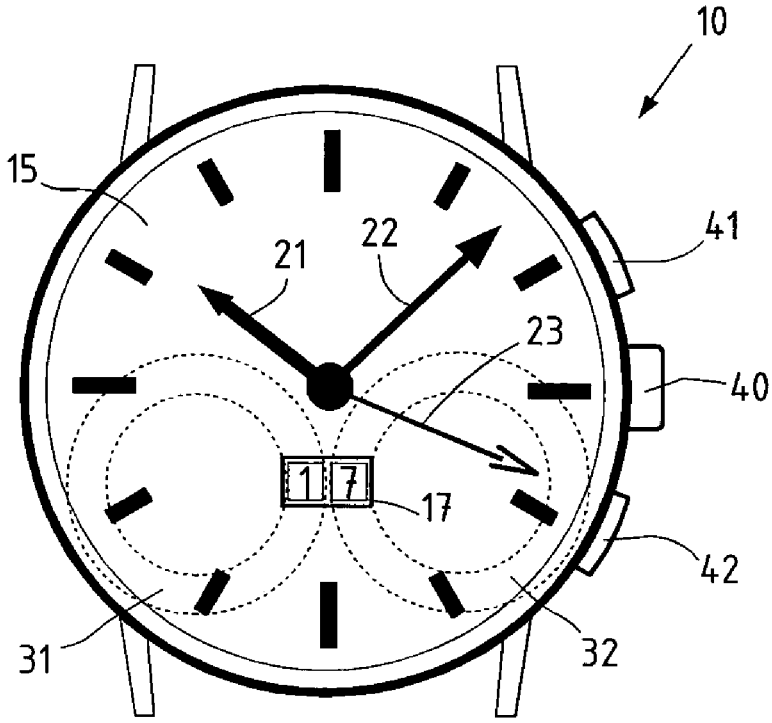
Fig. 1
Fig. 2
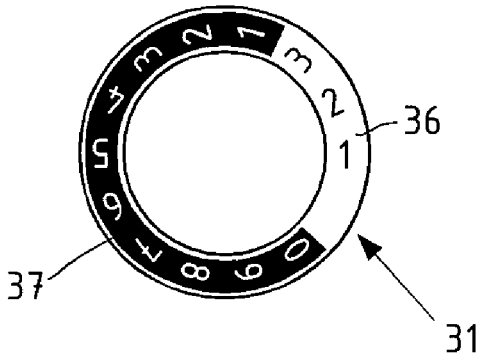
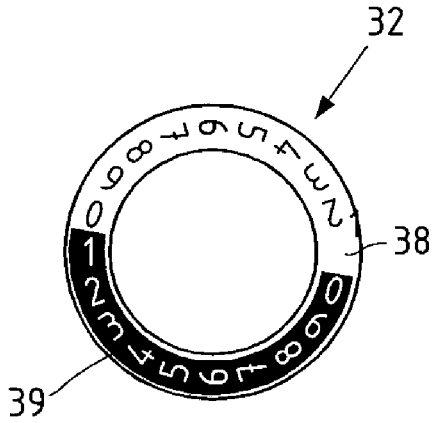
Fig. 3

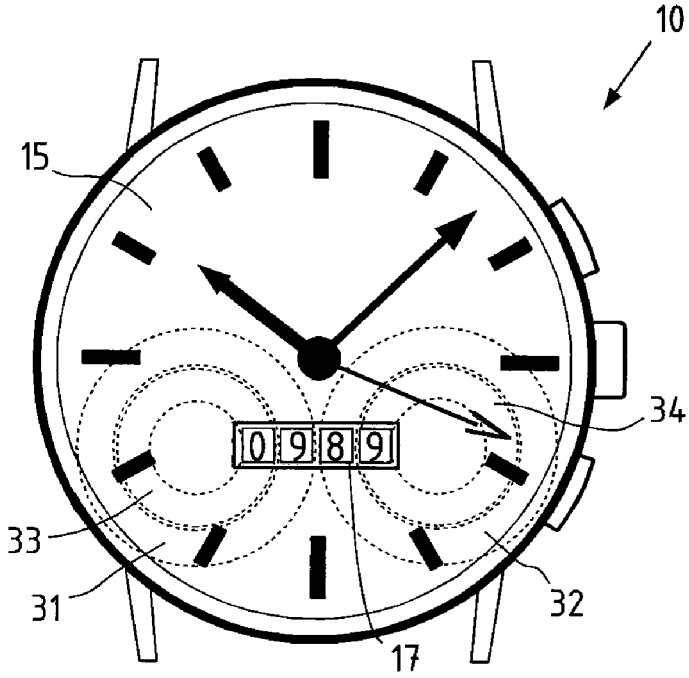
Fig. 7
Fig. 8
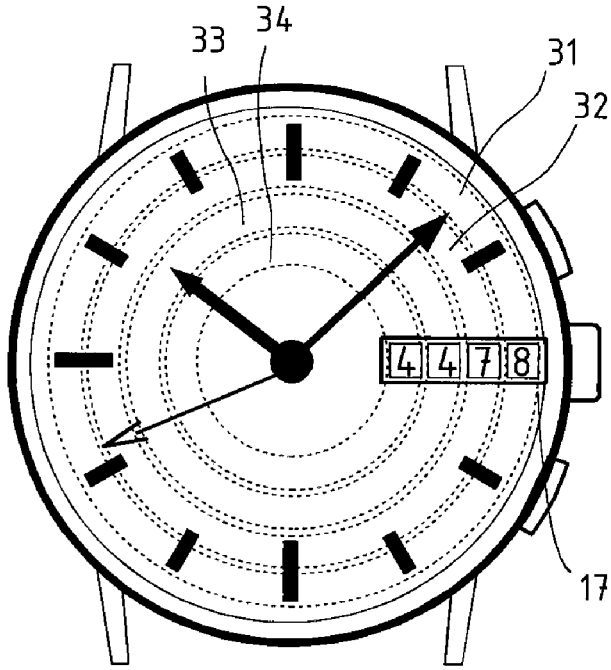

WATCH WITH A MULTIFUNCTIONAL DISPLAY

RELATED APPLICATIONS

The present application is a continuation of international application 2006WO-EP066209 (WO07031477) of Sep. 11, 2006, the content of which is included by reference, and which claims priority of Swiss patent application 2005CH-1485 of Sep. 13, 2005, the contents whereof are included by reference.

TECHNICAL FIELD

The present invention concerns a watch movement with a mechanism for displaying numeric or symbolic data in order to show indications independent of absolute time or of the time measured by the watch, as well as a watch provided with such a display.

STATE OF THE ART

Watch movements with hands allowing numeric or symbolic data to be displayed most often use one or several mobile discs bearing on their surface a sequence of digits or symbols corresponding to the information to display, for example to the 31 dates or to the days of the week in the case of a date display. The mobile disc is driven by the movement that makes it advance each day by an angle corresponding to the distance between the symbols or digits, for example, so as to make the required information appear through a date aperture in the watch dial.

This known mode of operation is well suited for making mechanical numeric date displays, for example for displaying the time or for displaying other information that changes slowly and at a regular rate relative to the absolute time determining the watch's running. It is very difficult with this type of mechanism to display information that is dynamic or that varies randomly.

Document WO2005006087 describes a watch provided with a chronograph comprising three apertures for the mechanical and numeric display of the minutes and hours measured by the chronograph. Another watch with three apertures is described in WO2002093273. Three indexed discs bearing digits turn behind the apertures to supply the required indication. This watch however requires a complex and delicate mechanism.

U.S. Pat. No. 5,668,78A describes a watch with a calendar indicator with a disc for indicating either the date in Arabic numbers or the year in Roman numbers. The indication presented through the aperture thus depends only on the absolute time.

CH190208 describes a clock with a multiple-disc perpetual date mechanism.

It is also known to provide a watch having an analog display and an electronic or mechanic movement with an electronic display mechanism, for example a LCD panel in the dial, capable of displaying digital, alpha-numeric or graphic information.

These mechanisms are used in multifunction watches and allow a greater freedom for visualizing information, including information varying randomly and that does not directly refer to the absolute time or to the time measured by the watch, for example atmospheric pressure, the depth, etc. However, this type of mechanic and electronic displays is not appreciated by a number of buyers who prefer the aesthetic aspect and the legibility of displays with hands and apertures.

Watches are also known in which the display of the auxiliary functions is ensured by small hands turning inside one or several eccentric dials, in order to indicate for example the time measured by the chronograph. This type of analog-type display is often difficult to read, especially when the graduations of the small dials comprise many subdivisions.

U.S. Pat. No. 5,475,653 describes a watch having a large aperture allowing pager numbers or other indications to be displayed. This document does not indicate how the user makes a distinction between the symbols displaying a first indication and those that are used to display another indication.

EP0744675 describes a watch with a date display in the aperture. By slightly shifting the date ring, it is possible to display battery end-of-life indications.

BRIEF DESCRIPTION OF THE INVENTION

One aim of the present invention is to propose a watch movement free from the limitations of the known mechanisms.

Another aim of the invention is to propose a watch movement capable of displaying information independent of absolute time without having to resort to electronic displays.

Another aim of the present invention is to propose a mechanic numeric display system that is easy to read for the auxiliary functions of a watch.

These aims are achieved by the mechanism that is the object of the main claim, whereas the dependent claims present optional features of the invention. Notably, these aims are achieved by a watch with an information display mechanism having: at least one display mobile bearing a sequence of symbols in its surface, at least one actuator associated with the mobile and capable of making the mobile rotate around an axis to cause the symbol or symbols corresponding to the information to be displayed to appear through one or several apertures. The display mechanism has at least one display mode according to which the symbol or symbols displayed in the aperture or apertures is independent of absolute time. The mobile or mobiles each bear at least two series of symbols or digits, each series of symbols or digits being distinguishable by a visual characteristic.

BRIEF DESCRIPTION OF THE DRAWINGS

Examples of embodiments of the invention are indicated in the description illustrated by the attached figures in which:

FIG. 1 illustrates in a simplified diagrammatic fashion a watch according to one aspect of the invention;

FIGS. 2 and 3 illustrate a disc for displaying the tens resp. the units in the watch of FIG. 1;

FIGS. 7 and 8 illustrate in a simplified diagrammatic fashion watches according to another aspect of the invention with a four-digit display;

EXAMPLES OF EMBODIMENT(S) OF THE INVENTION

Figure 4:
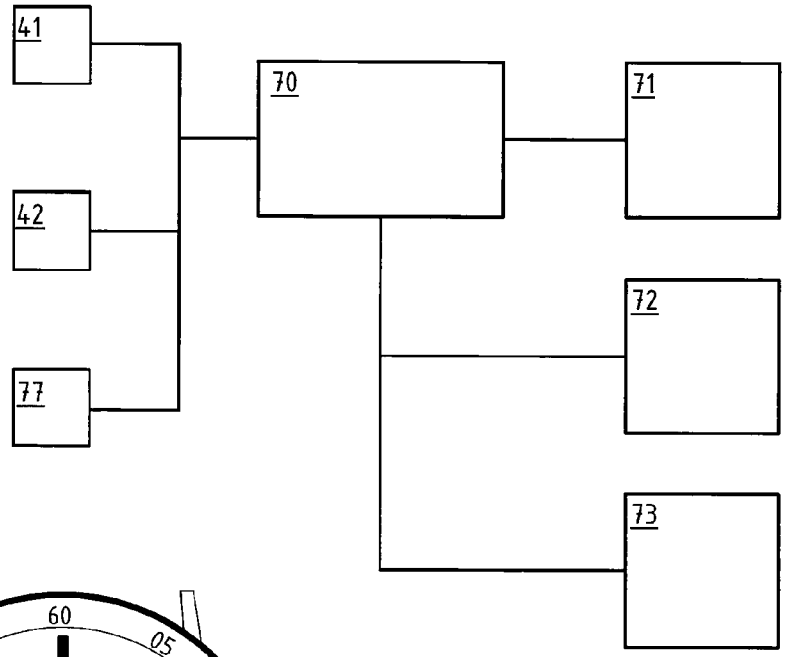
FIG. 4 represents a simplified bloc diagram of the watch's functioning according to one aspect of the invention.

With reference to FIGS. 1 to 4, the watch 10 comprises, in a conventional manner, a dial 15 for displaying the time by means of an hours' hand 21, a minutes' hand 22 and a seconds' hand 23. The running of the watch is ensured by an electronic quartz movement, represented in simplified manner in FIG. 4, having a logic unit 70 controlling an actuator 73, for example a stepping motor powered by pulses of well-determined rate, for example 1 Hz. The motor 73 drives the hands 21 and 22 through a cinematic chain, not represented.

Two apertures 17 are provided side by side in the dial 15 to allow two display mobiles 31 and 32, represented in FIGS. 2 and 3, to be visible, bearing on their surface a sequence of digits and/or letters and/or pictograms and/or any other graphic symbol. The mobiles 31 and 32 are represented in this embodiment as rings capable of rotating around their centre. In other variant embodiments of the invention, not represented, one or several mobiles could be made in the shape of a disc, cross, star or polygon, according to the number of digits and of symbols required on its surface, or be constituted by any mechanic part of suitable shape bearing a series of symbols. The apertures 17 are, according to this embodiment, placed correspondingly to 6 o'clock of the dial and the discs 31 and 32 rotate around two eccentric axes. This arrangement allows a great liberty in the arrangement of the watch's elements. Other arrangements are however possible, as will be seen further below.

In a first operation mode of the watch 10, the time is displayed with indication of the date. Each of the mobiles 31 and 32 is driven by an electro-mechanic actuator 71 resp. 72, for example a stepping motor, a direct current motor, or any other actuator whose size and power consumption make it suitable for use in watch-making. During normal running of the watch, the movement's logic unit 70 sends at midnight pulses to the actuator 72 of the units' mobile 32 and, if necessary, to the actuator 71 of the tens' mobile 31, in order to have the date indication visible through the apertures 17 move forward. Optionally, the logic unit 70 is programmed so as to run a perpetual calendar function.

The date display with two digits occurs preferably through two small openings 17 placed side by side, each opening being assigned to display a single digit or symbol. In this manner, the edges of the display mobiles are not visible. In the same fashion, three, four or more apertures placed side by side can be provided for displaying three, four or more digits or symbols, as will be seen further below.

The logic unit 70 is connected to the push buttons 41 and 42 on the watch's middle and records the action of the user on these buttons. The push buttons are used, in addition to their usual functions, for activating an auxiliary function of the watch 10, for example one or several functions from the following non-exhaustive list:

- chronograph
- diving/depth meter
- barometer (atmospheric pressure)
- thermometer
- weather forecast
- altimeter
- telephone call signal, signal that a call has been received on the user's mobile phone
- SMS messaging, e-mail or telephone answering machine
- diary, for example for storing meetings or birthdays
- visual alarm
- ON/OFF alarm
- indicator of sun ray intensity UV-A, UV-B
- speed
- acceleration
- jump height
- spin (rotation effected during an acrobatic figure)
- pulse-meter, training monitor
- metronome
- secret code reminder
- indication of the watch's serial number
- watch's working reserve
- compass
- navigation, distance and direction for reaching a predetermined destination
- count-down or regatta In the present example, the watch's auxiliary function or functions are activated by pressing on the push button or buttons 41, 42. The present invention however includes also watches allowing an auxiliary function to be activated by other means, for example by acting on the winding button 40, on the bezel, on a tactile glass or by any other appropriate control means.

Activating the auxiliary function causes the two mobiles 31 and 32 to display information independent of absolute time or of the time measured by the watch. To this effect, the two mobiles preferably bear two series of digits or symbols that are distinguished by a visual feature, for example by a difference in colour. In the illustrated embodiment, the tens' disc 31 comprises a series 36 of digits up to 3 for displaying the digit of the date's tens and a second series of digits 37, of different colour, for displaying the tens' digit for the auxiliary function. Similarly, the units' mobile 32 bears a series of digits 38 for displaying the date's unit and a series of digits 39 for displaying the units' digit of the auxiliary function.

In this embodiment, the direction of the series of digits is the same on both mobiles 31 and 32, with the digits increasing anti-clockwise in both discs.

The time-independent symbol can be displayed as independent symbol, in the place of a time-dependent symbol. It is thus possible to provide a mobile having a first sequence of symbols, for example digits, for indications dependent on absolute time, and one or several additional sequences for additional indications. It is also possible to provide mobiles having only indications independent of absolute time. In one embodiment, at least one indication independent of absolute time is displayed simultaneously with a symbol dependent on absolute time, for example in the form of an additional icon or of a particular choice of font colour, background colour or character font. It is for example conceivable to normally use black-and-white date digits and to replace them by digits of different colour when a particular condition is fulfilled, for example when the alarm is switched on.

The present invention also includes a watch provided with a mechanic numeric display system having at least one mobile bearing on its surface two or several series of symbols or digits distinguished by a visual feature, for example two or several series of digits of different colours, or of different background colours. The rotation of the mobile allows a digit to be seen through a aperture provided on the dial and the visual feature of the displayed digit indicates the nature of the presented information, for example the date or other information corresponding to another function of the watch, for example one of the functions indicated further above.

Figure 5:
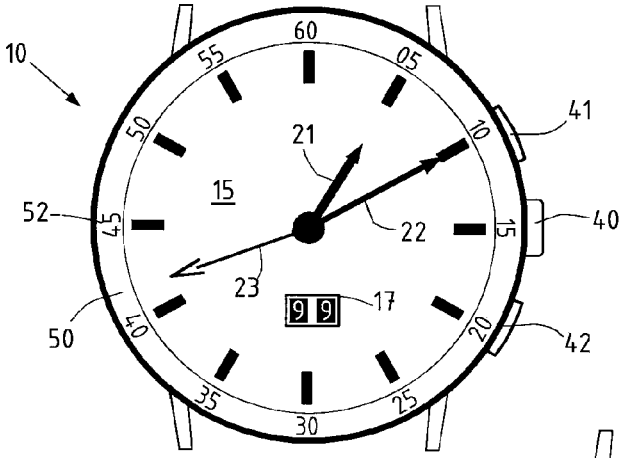
FIG. 5 illustrates in a simplified diagrammatic fashion a watch according to another aspect of the invention comprising a bezel bearing a graduated scale.

FIG. 5 shows an embodiment of the invention in which the display mechanism is used for displaying hundredths of seconds in chronograph function. The push buttons 41 and 42 are used in conventional manner for starting, stopping and resetting the chronograph. In chronograph mode, the actuator 73 makes the hands 21, 22, 3 turn to indicate the hours, the minutes and the seconds of the relative time totaled from the starting instant of the timing determined by a pressure on the push button 41. When the timing is stopped, for example by acting once again on the push button 41, the hands 21, 22, 23 stop and the mobiles 31 and 32 turn, under the action of the actuators 71 and 72 controlled by the logic unit 70, so as to display the hundredths of seconds timed with the series of digits 37 and 39 of a colour different from that used for the date.

During resetting, the logic unit 70 controls the actuators so as to display again the absolute time with the hands 21, 22, 23 and the date through the apertures 17.

The invention also includes a chronograph watch provided with a mechanism for displaying the hundredths of second through one or several apertures and, optionally, the possibility of displaying other information, according to the mode of functioning of the watch, for example for displaying the date when the chronograph mode is inactive.

According to another embodiment of the invention, now illustrated with reference to FIGS. 4, 9 and 10, the watch 10 provides an auxiliary depth gauge. For this purpose, the watch has a depth sensor 77, for example a pressure sensor, connected to the logic unit 70 of FIG. 4.

The depth gauge function can be activated upon request from the user, for example by pressing on one of the push button 41, 42 or, optionally, the depth gauge function can be triggered automatically when the depth sensor 77 detects a depth greater than a determined threshold.

Figure 9:
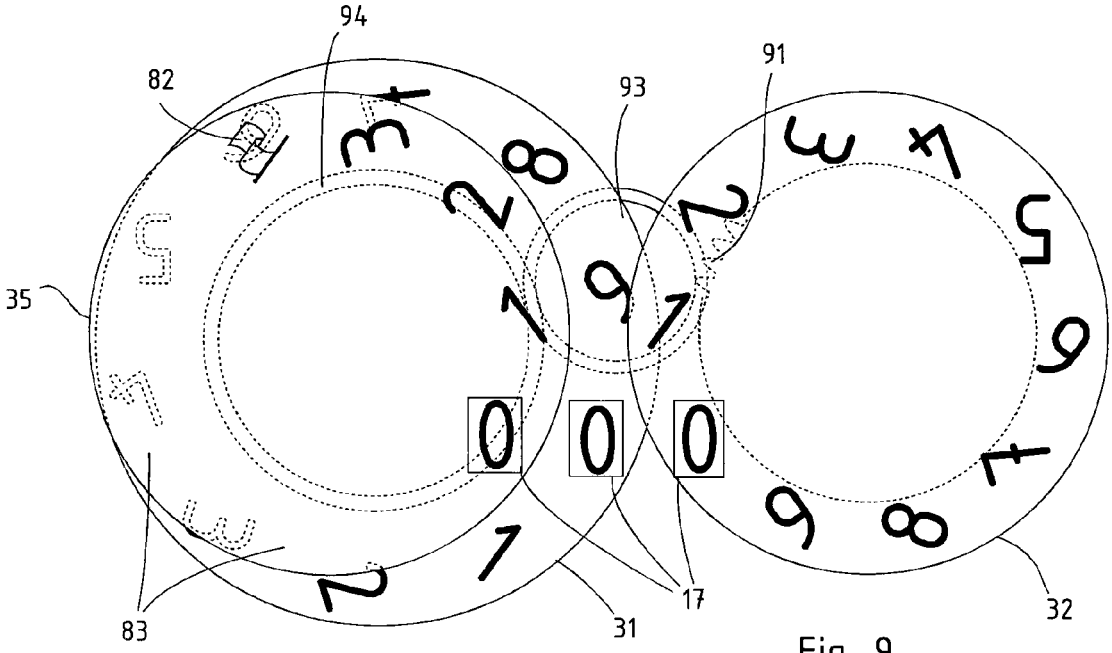
FIG. 9 illustrates in a simplified diagrammatic fashion display mobiles of a numeric and symbolic display with three digits according to one aspect of the invention.

According to this aspect of the invention, the watch 10 is provided with a numeric display with three digits illustrated in detail in FIG. 9. The display mechanism includes three mobiles 31, 32 and 35, each rotating around a distinct rotation centre having ten display positions available for displaying digits or symbols. The mobiles 31, 32 and 35 are made for example in the shape of a disc, a 10-pointed star or a 10-sided polygon. The digits and the symbols on the surface of the mobiles 31, 32 and 35 are inclined relative to the tangential direction so as to align correctly with the three aligned apertures 17 provided in the dial 15 at a position offset relative to the alignment of the rotation centres of the mobiles 31, 32 and 35. This arrangement makes it possible to maximize the size of the digits, and thus the readability of the display, and to optimize the space requirement of the mechanism in the watch movement.

In the represented example, the mobile 32 is designed for displaying the unit's digit of the date when the watch 10 is in normal mode (time mode), and of the unit's digit of the current depth when the diving mode is active. In the same manner, the mobile 31 is designed for displaying the ten's digit of the date resp. of the depth.

The mobile 35 is used only in diving mode for displaying the hundred's digit of the depth. It bears the digits 0, 1, 2, 3 for displaying the depth going, according to the chosen measurement unit, to 100 meters or 330 feet for example. The mobile 35 also bears one or more graphic symbols 82 or pictograms, for example to signal a danger situation. When the watch functions in normal mode, the mobile 35 is oriented so as to show one of the neutral positions 83.

The mobiles 32 and 35 are driven by the actuators 71 and 72 of FIG. 4. The mobile 31, on the other hand, is driven in this embodiment of the invention by a toothed sector fixedly united with the units' mobile 32 and a chain of one or more wheelworks 93 that engage in a toothed wheel 94 fixedly united with the tens' mobile 31. According to this arrangement, the tens' mobile 31 moves by one unit for each complete rotation of the units' mobile 32. Other mechanical transmissions are also possible and comprised within the frame of the present invention.

This arrangement makes easier the integration of the inventive display mechanism with a standard watch movement with two small counters that then fulfil the functions of the actuators 71 and 72. Other arrangements are however possible, for example the three mobiles 31, 32 and 35 could be moved by three independent bidirectional actuators.

Advantageously, the actuators 71 and 72 are bidirectional and allow the mobiles 31, 32 and 35 to rotate in both directions. In this manner, the watch can display the depth continuously both during descent (increasing indication) and during ascent (decreasing indication). This feature of the invention can also be adopted in combination with other features or for other auxiliary functions of a different nature.

Figure 10:
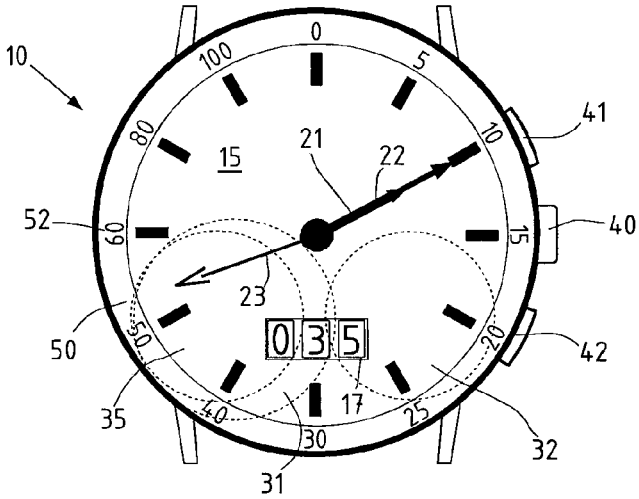
FIG. 10 illustrates in a simplified diagrammatic fashion a diver's watch with the display of FIG. 9 in diving mode.

With reference to FIG. 10, the seconds' hand 23 in diving mode indicates the maximum depth reached during diving on the scale 52 of the bezel 50. If the diver comes back up, it remains blocked at the maximum depth. If the diver then goes deeper down again, the seconds' hand 23 displays the new maximum depth reached.

The minutes' hand 22 indicates the duration of the dive, in minutes. When the diving mode is active, the hours' hand 21 places itself under the minutes' hand 22 if the diving time is lower than one hour. The hours' hand 21 indicates the diving hours for diving durations greater than one hour.

Optionally, the watch 10 returns autonomously to the normal functioning mode after a dive. Preferably, during the first three minutes outside the water, the watch remains in diving mode, the minutes' hand stops, but the internal counter of the diving time continues to turn.

If the diver dives again before expiration of the three minutes (or before a determined lapse of time), it will be considered to be the same dive. The minutes' hand then flies back to the internal counter of the diving time. Inversely, if the diver stays out of the water for more than three minutes, the dive will be considered to be finished. The watch then automatically switches to time mode.

Outside water, the manual activation of the diving mode by the push button 41 displays the maximum depth and the duration of the last dive carried out. These variables are reset manually, or automatically when the diver descends below the water surface.

The same or another pressure sensor may also allow altimeter and weather forecast functions to be realized. Other embodiments can require the use of a sensor or of several sensors 77 of different nature, for example:

- a temperature sensor for the thermometer function;
- a magnetic field sensor for the compass and regatta functions;
- an interface towards a wireless network, for example Bluetooth®, MSN®, GSM or another wireless telecommunication network, for the functions of telephone call signal, SMS, e-mail or voice message, telephone answering machine or diary;
- a solar radiation sensor for the function of detecting the sun radiation intensity UV-A-UV-B;
- a speed sensor, an accelerometer or a radiolocation interface, for the functions of measuring speed, acceleration, jump height, spin, navigation and regatta;
- a GPS receiver or any other geolocation receiver;
- a pulse sensor for the pulse-meter and training monitor functions.

Other possible functions, although they do not display quantities relative to absolute time or to time measured by the watch, do not require a specific sensor 77. Such are for example the functions of metronome, secret code reminder, indication of the watch's serial number or working reserve. In certain cases, one of the auxiliary modes of the watch can display information that is entered through the push buttons 41 and 42. A secret code or a wake-up time can be programmed by a sequence of actions on the push buttons 41 and 42 and displayed through the apertures 17 on request from the user.

Figure 6:
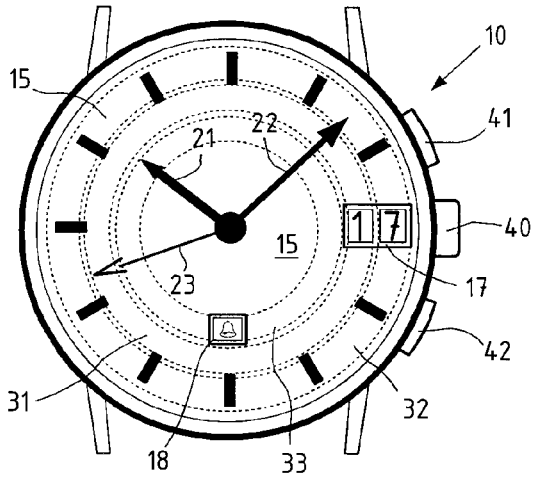
FIG. 6 illustrates in a simplified diagrammatic fashion a watch according to another aspect of the invention.

According to another embodiment of the invention presented in FIG. 6, the watch 10 can have three mobiles turning concentrically around the same axis. The number of mobiles is not limited and the inventive watch can have one, two, three or more mobiles bearing digits or symbols visible through one or several apertures of the dial. For example, a third disc 33, driven by one of the actuators 71, 72, 73 or by an actuator not represented is used according to this embodiment for displaying a symbol through a small aperture 18 at 6 o'clock, whilst the discs 31 and 32 allow a large-size display through the apertures 18 at 3 o'clock. Other arrangements, not represented, are also possible, where the mobile discs overlap partially or totally or are interlaced, with the upper disc possibly having mortises to allow the lower disc to be visible. The position and the number of the apertures 17 and 18 do not constitute either a limitation for the present invention that could also include watches with apertures in any position on the dial and even watches with a aperture provided in the bezel or in the middle, to allow an auxiliary function to be displayed.

In another embodiment represented in FIG. 7, the inventive watch includes four display mobiles 31, 32, 33 and 34 arranged in two groups of two concentric mobiles. The mobiles 31, 32, 33 and 34 are preferably driven by four independent bidirectional actuators commanded by the logic unit 70. Generally, the invention is not limited to a particular arrangement of the display mobiles but includes any arrangement of concentric mobiles or mobiles having distinct rotation axes. FIG. 8, for example, illustrates a variant of this latter embodiment of the invention including four concentric display mobiles 31, 32, 33 and 34.

The embodiments represented in FIGS. 7 and 8 include numeric displays with four digits visible through apertures 17. This feature is advantageous, for example, for an altimeter watch having an operation mode for displaying the altitude between 0 and 9999 meters. This variant embodiment is also advantageous for other auxiliary functions, for example barometer, count-down or secret code reminder.

The invention also includes displays with 5 or more digits, the number of digits being limited only by the size of the watch relative to the visibility of the symbols on the display mobiles. Symbolic displays, having 3, 4, 5 or more pictograms or other graphic symbols, or combinations of digits, letters, pictograms or any other graphic symbols, are also possible within the frame of the present invention.

Although the examples presented here have independent actuators for actuating the mobiles 31, 32, 33, 34, it will be understood that, within the frame of the invention, a single actuator could be arranged so as to act on several mobiles. For example, the units' disc 32 could be driven directly by an actuator, for example an electric motor, and itself drive the tens' disc 31 by means of a mechanic transmission, for example by having the tens' disc 23 turn by an angle corresponding to the distance between two digits for each complete revolution of the units' disc 31.

According to one embodiment of the invention, the same watch 10 can have more than one auxiliary mode. For example, the watch 10 can have, besides the diving mode, an altimeter mode, a barometer mode and a chronograph mode.

Although the examples presented here concern watches with an electronic movement, the one skilled in the art will understand very well that the invention also allows embodiments that are fully mechanical, as well as watches with a mechanical movement having an electronic display mechanism according to the invention.

The invention claimed is:

1. Watch with an information display mechanism having:

at least one display mobile bearing a sequence of symbols on its surface, at least one actuator associated to the mobile and capable of having the mobile turn around an axis to have at least one of said symbols corresponding to the information to display to become visible through one or several apertures, the display mechanism being capable of switching from one display mode to the other from among several display modes, where each operating mode is designed for representing information of a different nature, wherein each mobile bears at least two series of the same symbols each series of symbols or digits also having its own different distinct visual characteristic, said visual characteristic further indicating the nature of the information displayed.

2. Watch according to claim 1, wherein the symbol or symbols displayed in the aperture or apertures are dependent on the indications supplied by an electronic sensor of the watch the at least one of said series of symbols displayed in the aperture or apertures in at least one said display mode being independent of absolute time.

3. Watch according to claim 1, wherein the symbol or symbols displayed in the aperture or apertures are independent of the time measured by the watch.

4. Watch according to claim 1, wherein the aperture or apertures are provided in the dial of the watch.

5. Watch according to claim 1, wherein each of the mobiles is associated to an independent actuator.

6. Watch according to claim 1, wherein two or more mobiles are associated to a common actuator.

7. Watch according to claim 1, wherein the display mobile or mobiles include digits and pictograms.

8. Watch according to claim 1, wherein the symbols borne by the display mobile or mobiles have different colours according to the display mode for which they are intended.

9. Watch according to claim 1, wherein the symbols borne by the display mobile or mobiles have different background colours according to the display mode for which they are intended.

10. Watch according to claim 1, wherein the actuator or actuators are capable of imprinting a bidirectional rotation to the mobile or mobiles.

11. Watch according to claim 10, wherein the actuator or actuators include electric motors.

12. Watch according to claim 1, wherein the symbol or symbols displayed in the aperture or apertures correspond to a function selected from among: diving, dept meter, altimeter, telephone call signal, diary, ultraviolet detector, thermometer, barometer, speed, acceleration, pulse-meter, secret code reminder, compass, serial number indication, weather forecast, messaging signal, jump height, spin, navigation, regatta, chronograph, visual alarm, ON/OFF alarm, metronome, working reserve.

13. Watch according to claim 1, having also a date display mode through the aperture or apertures.

14. Watch according to claim 1, wherein the display mechanism allows numeric values or any other type of information with at least 4 digits or other symbols to be displayed.

15. Watch according to claim 1, wherein said symbol independent of absolute time is displayed in said aperture simultaneously with a symbol depending on absolute time.

16. Watch of claim 1, wherein at least one mobile has on the one hand a sequence or digits to display indications depending on absolute time and on the other hand letters or pictograms or any other graphical symbol for displaying indications independent of absolute time.

* * * * *

UNITED STATES PATENT AND TRADEMARK OFFICE

CERTIFICATE OF CORRECTION

PATENT NO. : 7,889,602 B2
APPLICATION NO. : 12/063629
DATED : February 15, 2011
INVENTOR(S) : Christoph Behling, Gregoire Renoux and Thomas Houlon It is certified that error appears in the above-identified patent and that said Letters Patent is hereby corrected as shown below:

Column 8, Line 23: Insert a --,-- after the word "symbols" and before the word "each"

Column 8, Line 26: Insert after the word "displayed" and before the "." the following: --the at least one of said series of symbols displayed in the aperture or apertures in at least one said display mode being independent of absolute time--

Column 8, Line 30-33: After the word "watch", delete the words "the at least one of said series of symbols displayed in the aperture or apertures in at least one said display mode being independent of absolute time"

Signed and Sealed this
Twenty-sixth Day of April, 2011

David J. Kappos

David J. Kappos
*Director of the United States Patent and Trademark Office*